United States Patent [19]

Quan

[11] Patent Number: 4,643,960

[45] Date of Patent: Feb. 17, 1987

[54] DEVELOPING POWDER COMPOSITION CONTAINING A FATTY ACID AMIDE COMPONENT

[75] Inventor: Nancy N. Quan, Mounds View, Minn.

[73] Assignee: Minnesota Mining and Manufacturing Company, St. Paul, Minn.

[21] Appl. No.: 617,695

[22] Filed: Jun. 6, 1984

Related U.S. Application Data

[63] Continuation of Ser. No. 155,308, Jun. 2, 1980, abandoned.

[51] Int. Cl.[4] ..... G03G 9/14

[52] U.S. Cl. ..... 430/106.6; 430/107; 430/110

[58] Field of Search ..... 430/107, 110, 106.6

[56] References Cited

U.S. PATENT DOCUMENTS

| | | | |
|---|---|---|---|
| 3,639,245 | 2/1972 | Nelson | 430/110 |
| 3,830,750 | 8/1974 | Wellman | 430/138 |
| 3,983,045 | 9/1976 | Jugle et al. | 430/110 |
| 4,076,641 | 2/1978 | Scouten et al. | 430/120 |
| 4,099,968 | 7/1978 | Scouten et al. | 430/120 |
| 4,273,847 | 6/1981 | Lennon | 430/106.6 |

*Primary Examiner*—John D. Welsh

*Attorney, Agent, or Firm*—Donald M. Sell; James A. Smith; James V. Lilly

[57] ABSTRACT

A toner powder comprising a thermoplastic binder, a pigment, and a fatty acid amide containing at least about ten carbon atoms is provided. Addition of the amide has no deleterious effects upon the composition yet renders the toner readily processable.

15 Claims, 2 Drawing Figures

DEVELOPING POWDER COMPOSITION CONTAINING A FATTY ACID AMIDE COMPONENT

This is a continuation of application Ser. No. 155,308 filed June 2, 1980, now abandoned.

FIELD OF THE INVENTION

This invention relates to developing powder compositions (sometimes referred to herein as toner powders) useful in electrostatic copying processes and to the methods of preparing such compositions. More particularly, it relates to both heat-fusible and pressure-fixable dry developing powders that can be prepared employing lower temperatures and shorter times with excellent reproducibility.

Many developing powder compositions and methods for their preparation have been suggested. Thus, for example, see U.S. Pat. Nos. 3,639,245; and 3,925,219. These patents respectively describe heat-fusible and pressure-fixable developing powders that employ a conductive material, such as carbon black, in a binder material.

In preparing these powders, a dry-powdered blend of a desired composition is first obtained by, for example, melting the material or materials of the binder, stirring in a first pigment or blend of pigments, allowing the mixture to cool, and grinding and classifying the resulting solid mixture to the desired particle size (i.e., 1 to 40 microns maximum dimension).

The powder, which is irregular in shape, is then formed into "prespheres" by first aspirating it into a moving gas stream, preferably air, thus creating an aerosol, and then directing the aerosol at an angle of about 90°±5° through a stream of gas, preferably air, which has been heated to about 450° C. and 600° C. into a cooling chamber where the now substantially spherical particles are allowed to settle by gravity as they cool.

The prespheres are then dry blended with a second pigment and heated, with agitation, at a temperature less than the melting point of the resinous material used in the binder but sufficiently high so that said material will soften and allow the second pigment to embed therein. The powder is then, optionally, directed at about 90°±5° through a stream of gas, preferably air, heated to a temperature between about 370°–425° C. for a time sufficient to permit the second pigment to become essentially completely embedded in the binder. The particles are then collected, by, for example cyclone separation, and are preferably blended with a flow agent, such as finely divided silica.

The dry blending step typically requires extensive times and high temperatures in order to effectively embed the pigment into the resinous material of the binder. Thus, for example, times of 13 hours or more can be required in order to achieve effective embedment. Such extensive processing time reduces the speed and efficiency of the entire process. Additionally, both lot-to-lot variations in a particular resin and variation between different types of resin used as the binder frequently necessitate that different dry blending conditions be employed in order to achieve a given degree of embedment. The present invention, however, overcomes these disadvantages.

DISCLOSURE OF INVENTION

In accordance with the present invention there is provided a flowable, dry developing powder which comprises a plurality of particles, said particles comprising a thermoplastic binder, a pigment, and from about 0.05 to 2% (preferably 0.1 to 0.5%) by weight of said particles of a fatty acid amide containing at least about 10 (preferably between about 18 and 22) carbon atoms.

The toner powders of the present invention require substantially less processing time during the dry blending step than do those referred to above. Additionally they can be reproducibly prepared at essentially a single processing temperature thereby eliminating at least one processing variable, i.e., based upon the variability in the resin used in the binder. Moreover, the toner powder surprisingly possess good blocking characteristics, i.e., it remains a free-flowing powder over a wide temperature and humidity range despite the addition of the amide additive.

DETAILED DESCRIPTION

Figure 1:
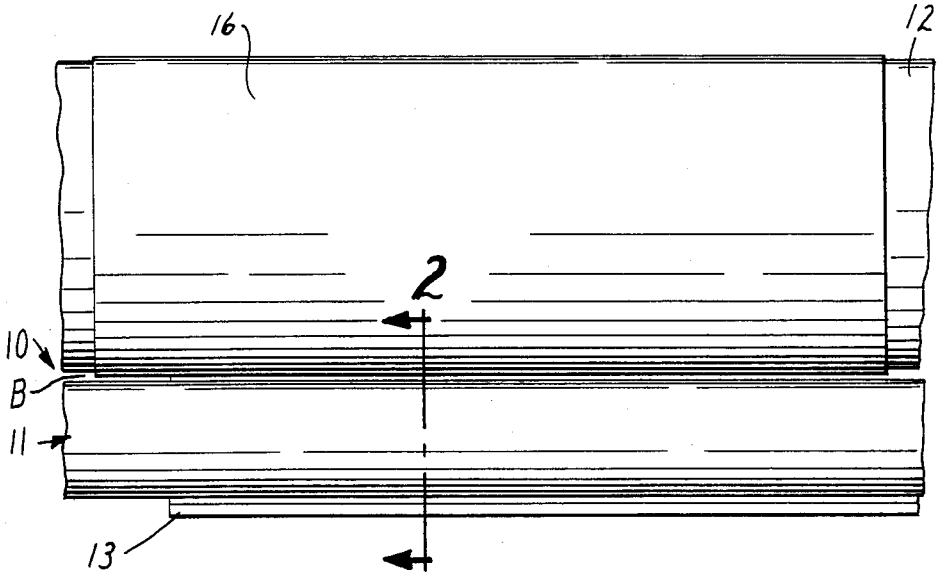
FIG. 1 shows a top view of a portion of the apparatus used to measure free carbon value (described hereinafter)
Figure 2:
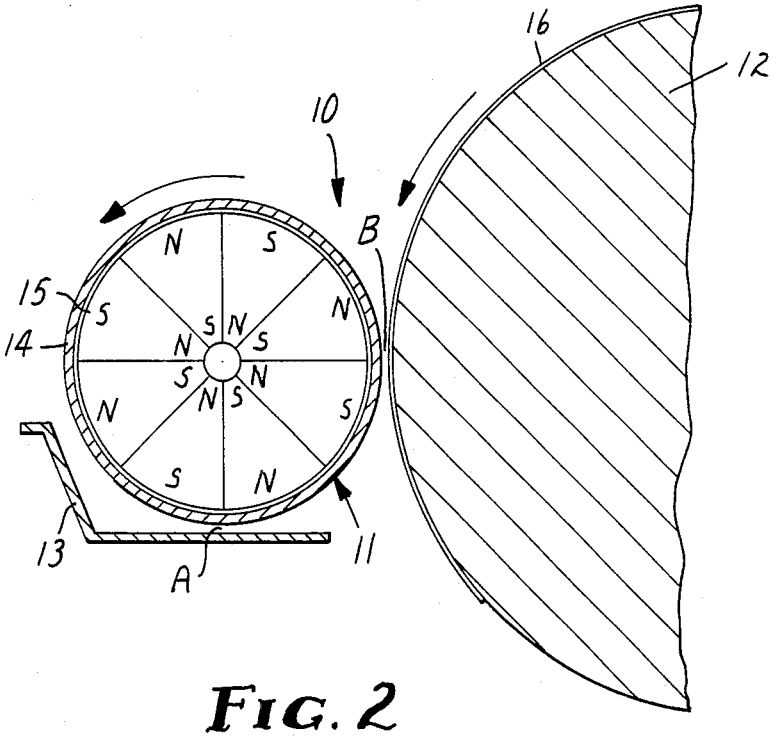
FIG. 2 shows a section view along the lines 2—2 of FIG. 1 of said apparatus.

The flowable, dry developing powder of the present invention preferably has a static conductivity of less than about $10^{-3}$ mhos/cm in an electric field of 10,000 d.c. volts/cm. The static conductivity referred to herein is measured according to the technique described at column 3, line 54 through column 4, line 47 of U.S. Pat. No. 3,639,245.

Additionally, the developing powder of the invention preferably has a number average maximum dimension below about 20 microns. Preferably it is between about 10–15 microns. The average particle size range of the developing powder is such that at least about 95 number percent of the particles have a diameter greater than about 2 microns while no more than about 5 number percent have a diameter greater than about 30 microns.

As noted above, the developing powder has good bulk blocking properties. Thus, the addition of the fatty acid amide does not have a deleterious effect upon the flow characteristics of the toner powder of the invention.

The fatty acid amides useful in the present invention are solid materials that have relatively high melting points and relatively low solubility in common solvents. They have a relatively long hydrocarbon chain, that is, one containing at least ten carbon atoms, which terminates with the amide group. The hydrocarbon chain may be either saturated or unsaturated, although unsaturated chains are preferred. The chain is typically linear.

Representative examples of useful fatty acid amides include erucamide, stearamide, behenamide, and oleamide. These materials are available as "Kemamide" E, S, B, and U respectively from Humko-Sheffield.

Other useful fatty acid amides include N,N'-ethylene-bis(tall oil) amide and N,N'-ethylene-bis-oleamide. These materials are available as "Kemamide" W-10 and W-20 from Humko-Sheffield. The tall oil amide is the amidized by-product from sulfate wood pulp digestion. The by-product comprises mainly resin acids and fatty acids such as linoleic acid, abietic acid, linolenic acid; some oleic acid, with 2,2'-dihydrostigmasterol and lignoceryl alcohol.

The binder of the toner powders is thermoplastic in nature and, preferably, has a static conductivity of at most $10^{-12}$ mhos/cm. It may be formulated so that the resultant toner powder is either heat-fusible or pressure-fixable. In either event, the binder may comprise any thermoplastic material, although thermoplastic organic resins are preferred.

Representative examples of useful thermoplastic organic resins that may be used to prepare the toner powders of the invention include polyamides (e.g., "Versamid" 950, available from General Mills); polystyrenes; epoxy resins such as those that comprise the reaction product of epichlorohydrin and bisphenol A (e.g., "Epon" 1004, available from Shell Chemical Corporation); acrylic resins (e.g., "Elvacite" 2044, and butyl methacrylate both available from DuPONT); acrylic copolymers such as styrene n-butylmethacrylate copolymer (e.g., "Ionac" X-231, 65% styrene and 35% n-butylmethacrylate, available from Ionac Chemical Company); vinyl resins such as polyvinyl butyral; polyvinyl acetates; vinyl copolymers such as vinyl chloride vinyl acetate (e.g., "VYHH", commercially available from Union Carbide Corp.), ethylene vinyl acetate copolymers; cellulose esters such as cellulose acetate butyrate and cellulose ethers. These resins may be used either individually or in combination with each other in the binder.

Heat-fusible toner powders typically employ organic resins, such as those described above, that have a softening point above about 50° C. in the binder. However, other ingredients may be added if desired. Thus, for example, wax components may be utilized in the binder to give said binder a melt index between about 2 and 8 times the melt index of the organic resin. The wax has a melting point above about 60° C. and reduces the temperature necessary to achieve effective fusing of the toner to a desired surface. Preferably, the weight ratio of the organic resin to the wax component is between about 4:1 and 20:1. Most preferably it is about 9:1.

Examples of useful wax components are selected from the group consisting of aliphatic compounds such as waxes (either natural or synthetic), fatty acids, glycerides of 12-hydroxystearic acid, N(2-hydroxyethyl)-12-hydroxystearamide, and the reaction product of stearic acid and ethanolamine. Particularly useful wax components include N(2-hydroxyethyl)-12-hydroxystearamide and glycerides of 12-hydroxystearic acid.

Pressure-fixable toner powders typically employ one or more of the organic resins described above in conjunction with a wax component having a melting point between about 45° C. and 150° C. (and preferably between about 65° C. and 125° C.).

Pressure-fixable toner powders of this type are described in U.S. Pat. No. 3,925,219. The binder of these toner powders comprises from about 50 to 100 parts by weight of the wax component and from about 2 to 50 parts by weight of a thermoplastic organic resin having a softening point above about 60° C. Preferably the resin has a ring and ball softening point between 120° C. and 200° C.

The wax component is normally selected from the group consisting of aliphatic compounds such as waxes (natural or synthetic), fatty acids, metal salts of fatty acids, hydroxylated fatty acids or amides, ethylene homopolymers, or a mixture of two or more of these materials. Aromatic or polymeric wax-like materials can also be used, e.g., dicyclohexylphthalate and diphenylphthalate. All of these materials are well known in the art.

Representative useful aliphatic waxes include paraffin wax, microcrystalline wax, carnauba wax, montan wax, ouricury wax, ceresin wax, candelilla wax, and sugar cane wax.

Representative useful fatty acids include stearic acid, palmitic acid, and behenic acid. Representative useful metal salts of fatty acids include aluminum stearate, lead stearate, barium stearate, magnesium stearate, zinc stearate, lithium stearate, and zinc palmitate. Representative amide hydroxy waxes include N(betahydroxyethyl) ricinoleamide (commercially available under the trade name "Flexricin 115"), N,N'-ethylene-bis-ricinoleamide (commercially available under the trade name "Flexricin 185"), N(2-hydroxyethyl)-12-hydroxystearamide (commercially available under the trade name "Paracin 220"), and N,N'-ethylene-bis-12-hydroxystearamide (commercially available under the trade name "Paracin 285").

Representative fatty acid derivatives include castor wax (glyceryl tris-12-hydroxy stearate), methyl hydroxy stearate (commercially available under the trade name "Paracin 1"), ethylene glycol monohydroxy stearate (commercially available under the trade name "Paracin 15") and hydroxy stearic acid.

Another binder system for pressure-fixable toner powders is described in U.S. Pat. No. 3,965,022. This patent describes a binder that comprises (a) about 74 to 98 parts by volume of a thermoplastic component that has a softening point of at least about 60° C., a 10-second shear creep compliance in the range of about $1\times10^{-9}$ $cm^2$/dyne to $1\times10^{-13}$ $cm^2$/dyne at room temperature, and a "heat deflection temperature" below about 300° C., and (b) about 2 to 26 parts by volume of a non-volatile component having a principal glass transition temperature below about 0° C. as measured by differential thermal analysis, and a 10-second shear creep compliance in the range of about 50 $cm^2$/dyne to $8\times10^{-8}$ $cm^2$/dyne at room temperature, said non-volatile component preferably being elastomeric.

Examples of useful thermoplastic components (i.e., low shear creep compliance materials) and of non-volatile components (i.e., high shear creep compliance materials) are disclosed in the '022 patent. The disclosures of that patent are incorporated herein by reference for the disclosure of the binder system.

The pigment employed in the present invention makes the toner powder visible when fixed to a desired surface. It may be either conductive or non-conductive.

Examples of useful pigments include electrically conductive materials such as conductive carbon particles (e.g., those available under the trade name "VULCAN XC-72R" available from Cabot Corporation) are preferred. Other electrically conductive carbon particles that may be employed include "Conductex 950" available from City Service Company, "Raven 1800" available from Columbia Chemicals; and "Thermax MT" available from R. T. Vanderbilt. Electrically non-conductive carbon particles may also be utilized in the toner powders.

Still other pigments that may be employed are magnetizable particles. Such particles preferably have a major dimension of one micron or less and include magnetite, barium ferrite, nickel zinc ferrite, chromium oxide, nickel oxide, etc. A particularly preferred embodiment of the invention utilizes both magnetizable particles (as a first pigment) and conductive carbon particles (as a second pigment) in the toner powder.

Various other materials may be usefully incorporated in or on the toner powder particles of this invention. Thus, for example, flow agents, dye stuffs, plasticizers, and processing aids may be utilized.

Useful flow agents include, for example, small size $SiO_2$. Such materials may be purchased from the DeGussa Corporation as "Aerosil".

The developing powders of the invention may be prepared by the techniques described hereinabove with the exception that the fatty acid amide component is preferably incorporated into the toner powder particles during the dry blending step together with the second pigment.

The significant advantages in processing time and product uniformity achieved by the present invention may be demonstrated by preparing a magnetically responsive toner powder that has electrically conductive carbon particles embedded therein. The degree of carbon embedment after various dry blending conditions is measured by the test described below. The results are reported in terms of light reflectance and are referred to as free carbon values. Low values, indicate a high degree of embedment and, correspondingly, a toner powder that has uniform conductivity. High values indicate a low degree of embedment and, correspondingly, a toner powder that has a non-uniform conductivity.

The test will be better understood with reference to the accompanying drawings. The drawings illustrate a device 10 used for testing the free carbon value. The device 10 comprises a magnetic roll 11, a development roll 12, and a toner hopper 13. A section of paper 16 is provided on the development roll.

Magnetic roll 11 comprises an aluminum shell 14 around a segmented 8 pole magnet 15. Shell 14 rotates in a counterclockwise direction and magnet 15 is stationary. A driving means, which is not shown but which may comprise an electric motor, rotates shell 14.

The diameter of roll 11 is conveniently, about 3.8 centimeters (cm). The length of roll 11 is, typically, about 28 cm. It is rotated at a speed of 50 rpm.

Toner hopper 13 is provided beneath magnetic roll 11 and along its length. It is moveably joined to device 10 so that the gap A between shell 14 and the hopper 13 can be adjusted to a desired opening. In the free carbon test, gap A is adjusted to provide a 0.033 cm opening.

Development roll 12 comprises a hollow aluminum drum. It is preferably about 10 cm in diameter and 25 cm in length. It is moveable so that the gap B between it and the magnetic roll 11 may be adjusted to a desired opening. In the free carbon test, gap B is adjusted to provide a 0.048 cm opening. The development roll rotates at 25 rpm in a clockwise direction in the embodiment shown. It is driven by a motor which is not shown.

The free carbon test is performed according to the following procedure. Gaps A and B are adjusted to respectively provide 0.033 cm and 0.048 cm openings. A portion (20–30 grams) of toner powder to be tested is placed in the left half of hopper 13. Shell 14 is rotated thereby causing the magnetically attractable toner powder to move over the left half of its surface until it forms a uniform layer on the left half of said surface. A section of Type T350 paper, available from 3M Company, is applied and taped to the surface of development roll 12 so that there are no wrinkles in the paper. The paper 16 is positioned in such a manner that a border of approximately 4 cm is provided on the left side of the paper to which no toner powder is latter applied. See FIG. 1 for a representation of the position of the paper. The development roll is then rotated in a clockwise direction for ten revolutions at a rate of 25 revolutions per minute. The paper 16 is then removed from the development roll and the brightness of the toner portion side is measured along with the brightness of the untreated margin using a photovolt meter, model 670, available from Triplett Electrical Engineering Company. The difference between the reflectance on the untreated margin and the treated portion of the paper is the free carbon number. The greater this difference (i.e., the higher the free carbon number) the more free carbon present and, consequently, the less complete the embedment.

Even though the test described herein measures only free carbon, it is not intended to limit the invention. Thus, use of the fatty acid amide will have the effect of reducing the time and temperature necessary to achieve acceptable levels of free pigment in the toner powder composition no matter what the nature of the pigment used.

The present invention is further illustrated by means of the following examples wherein the term "parts" refers to parts by weight unless otherwise indicated.

Preparation of Prespheres

A master batcn of toner powder prespheres was prepared from the following ingredients using the amounts shown

| | Parts |
|---|---|
| Epoxy Resin (reaction product of epichlorohydrin and bisphenol A, available from Shell Chemical Company as "Epon" 1004) | 40 |
| Magnetite | 60 |

The epoxy resin was first heated to melting after which the magnetite was added with stirring and continued heating until a homogeneous dispersion was obtained. The dispersion was then allowed to cool and solidify.

The solidified composition was broken into flakes, chilled with dry ice, and reduced to fine powder particles using a hammer mill and an air jet mill.

The powder was fed to an air aspirator in a uniform stream of about 40 grams per minute. The aspirator sucked the particles into the airstream and dispersed them, forming an aerosol. This aerosol was directed at an angle of 90°±5° into an airstream, heated to about 425° C. The powder was then allowed to settle and was collected by filtration. It was then classified to obtain the desired particle size.

EXAMPLES 1-2 (COMPARATIVE)

Toner powder compositions were prepared from separate portions of the prespheres by dry blending 100 parts of the prespheres with three parts of carbon black ("Vulcan" XC-72R from Cabot Corporation), at 60° C. for various times. The resulting powders were then tested for free carbon content and the values recorded. The dry blending times, and free carbon values obtained are set forth in Table 1.

TABLE 1

| | 1 | 2 |
|---|---|---|
| Dry Blending | | |

TABLE 1-continued

| | 1 | 2 |
|---|---|---|
| Time (hrs) | 8 | 12 |
| Free Carbon Value | 33 | 24.8 |

These results indicate that even after lengthy dry blending times at 60° C., a substantial amount of free carbon remains. This results in unsatisfactory toner powders in that they do not have uniform conductivity.

EXAMPLES 3-6

Toner powder compositions were prepared from separate portions of the prespheres according to the procedures described in Examples 1-2 by dry blending 100 parts prespheres, 3 parts carbon black, and 0.5 parts erucamide at 60° C. for 8 hours. The free carbon values obtained are set forth in Table 2.

TABLE 2

| | 3 | 4 | 5 | 6 |
|---|---|---|---|---|
| Dry Blending | | | | |
| Time (hrs) | 8 | 8 | 8 | 8 |
| Free Carbon Value | 14 | 13 | 12 | 13 |

This data, when compared with that of Examples 1-2, clearly demonstrates that substantially less time at 60° C. is required during dry blending in order to achieve acceptable free carbon values.

EXAMPLES 7-10

Prespheres were prepared as described above except that the thermoplastic binder comprised 90 parts by weight "Epon" 1004 and 10 parts by weight of a wax component. The resulting prespheres were utilized to prepare various toner powders according to the procedures described in Examples 1-2 using various dry blending conditions. Three parts carbon black and, in some cases, 0.5 part erucamide were dry blended with 100 parts prespheres. The wax used, the presence of erucamide, the dry blending conditions employed, and the results obtained are given in Table 3.

TABLE 3

| | 7 | 8 | 9 | 10 |
|---|---|---|---|---|
| Wax | A | A | B | B |
| Erucamide | None | Yes | None | Yes |
| Dry Blending Conditions | | | | |
| Time (hrs) | 13 | 8 | 13 | 8 |
| Temp. (°C.) | 57 | 60 | 57 | 60 |

A A synthetic wax prepared by the essentially complete hydrogenation of castor oil. Its principal constituent is the glyceride of 12-hydroxystearic acid. It contains minor quantities of glycerides of 12-hydroxystearic acid, dihydroxystearic acid and stearic acid. It is available from N.L. Industries as Castor wax.
B Ouricury wax Examples 7 and 8 each had substantially the same free carbon value. Examples 9 and 10 each had substantially the same free carbon value. However, the toners of Examples 8 and 10 required substantially less time during dry blending to achieve that free carbon value than did the toners of Examples 7 and 9.

When Examples 7 and 9 were repeated at dry blending temperature of 60° C., the toner powder quickly agglomerated and could not be further processed.

EXAMPLES 11-18

Toner powder compositions were prepared according to procedures described in Examples 1-2 by dry blending 100 parts prespheres, 3 parts carbon black, and various amounts of different fatty acid amides. Dry blending was accomplished in 8 hours at 60° C. All of the samples had good free carbon values and were used to prepare good copies using an electrostatic copying process.

The fatty acid amides and the quantity of each used are given in Table 4.

TABLE 4

| | 11 | 12 | 13 | 14 | 15 | 16 | 17 | 18 |
|---|---|---|---|---|---|---|---|---|
| Fatty acid amide (Parts) | | | | | | | | |
| Erucamide | 0.1 | 0.5 | | | | | | |
| Behenamide | | | 0.1 | 0.5 | | | | |
| Oleamide | | | | | 0.1 | 0.5 | | |
| "Kemamide" W-10 | | | | | | | 0.1 | |
| "Kemamide" W-20 | | | | | | | | 0.1 |

EXAMPLES 19-20

Prespheres were prepared as described above except that a different lot of "Epon" 1004 was used. The prespheres were then used to prepare toner powders according to the procedures described in Examples 1-2 except that erucamide was used in Example 19 and not in Example 20. Dry blending was carried out at 60° C. Samples of the toner powders were taken at various times and the free carbon values were determined. The formulations and free carbon values at various times are given in Table 5.

TABLE 5

| | 19 | 20 |
|---|---|---|
| Formulation (Parts) | | |
| Prespheres | 100 | 100 |
| Carbon Black (Vulcan XC-72R) | 3 | 3 |
| Erucamide | 0.5 | — |
| Free Carbon Value | | |
| 2 hrs. dry blending | 33 | 43 |
| 4 hrs. dry blending | 17.7 | 28 |
| 6 hrs. dry blending | 15 | 22 |

I claim:

1. A flowable, dry developing powder composition which consists essentially of a plurality of particles each comprising (i) preparticles containing a mixture of a thermoplastic binder and a magnetically responsive pigment, (ii) a layer of from 0.05 to 2% by weight of said preparticles of a fatty acid amide containing at least about 10 carbon atoms essentially permanently adhered to the surface of said preparticles, and (iii) a conductive non-magnetizable pigment embedded in the surface of said layer.

2. A powder according to claim 1 having a static conductivity of less than about $10^{-3}$ mho/cm in an electric field of 10,000 d.c. volts/cm.

3. A powder according to claim 1 wherein said conductive non-magnetizable pigment is carbon black.

4. A powder according to claim 1 wherein said fatty acid amide is selected from the group consisting of erucamide, stearamide, behenamide, oleamide, N,N'-ethylene-bis (tall oil) amide, and N,N'-ethylene-bis-oleamide.

5. A powder according to claim 4 wherein said amide is erucamide.

6. A heat-fusible powder according to claim 1.

7. A powder according to claim 1 wherein said thermoplastic binder comprises the reaction product of epichlorohydrin and bisphenol A.

8. A pressure-fixable powder according to claim 1.

9. A powder according to claim 1 wherein said thermoplastic binder comprises a mixture of ethylene vinyl acetate copolymer and wax.

10. A method of toner formation comprising the steps of:

providing a plurality of small dimension preparticles of a thermoplastic resin and a magnetically responsive pigment;

forming a layer of a fatty acid amide containing at least about 10 carbon atoms on the surface of said preparticles, essentially permanently adhering said amide to the surface of said preparticles, and embedding a conductive non-magnetizable pigment in the surface of said layer by blending said preparticles with said fatty acid amide and said conductive non-magnetizable pigment at a temperature and for a time sufficient to (1) form and essentially permanently adhere said layer of said fatty acid amide on the surface of said preparticles and (2) embed said conductive non-magnetizable pigment in said layer.

11. A method according to claim 10 wherein said conductive non-magnetizable pigment is embedded in said layer of fatty acid amide at a temperature of about 60° C.

12. A method according to claim 11 wherein said blending is carried on for about 8 hours.

13. A method according to claim 10 wherein prior to said blending, said preparticles are directed at an angle of 90°±5° through a stream of gas heated to a temperature between about 450° C. and 600° C. so as to render said preparticles essentially spherical.

14. A method according to claim 10 wherein, subsequent to said blending, said toner is directed at an angle of 90°±5° through a stream of gas heated to a temperature between about 370° C. and 425° C. for a time sufficient to essentially completely embed said conductive non-magnetizable pigment.

15. A flowable, dry developing powder composition which consists essentially of particles each comprising:

(i) preparticles containing a mixture of a thermoplastic binder and a magnetically responsive material;

(ii) a layer of a fatty acid amide component essentially permanently adhered to the surface of said preparticles, said amide containing from 18 to 22 carbon atoms, and (iii) conductive carbon black particles embedded in the surface of said layer.

* * * * *